United States Patent [19]

Goff

[11] 4,394,256

[45] * Jul. 19, 1983

[54] APPARATUS FOR SEPARATING ABRASIVE BLASTING MEDIA FROM DEBRIS

[76] Inventor: James R. Goff, Rte. 1, Box 247AB, Seminole, Okla. 74868

[ * ] Notice: The portion of the term of this patent subsequent to Dec. 21, 1999, has been disclaimed.

[21] Appl. No.: 330,042

[22] Filed: Dec. 11, 1981

Related U.S. Application Data

[63] Continuation-in-part of Ser. No. 232,465, Feb. 9, 1981, Pat. No. 4,364,823.

[51] Int. Cl.[3] ..... B07B 7/04

[52] U.S. Cl. ..... 209/135; 209/149; 209/154; 51/425; 51/429

[58] Field of Search ..... 51/424, 425, 429; 209/32, 33, 133–137

[56] References Cited

U.S. PATENT DOCUMENTS

| | | | |
|---|---|---|---|
| 2,635,745 | 4/1953 | Mead et al. | 209/137 X |
| 2,643,769 | 6/1953 | Tanner | 209/137 X |
| 2,707,314 | 5/1955 | Horth | 209/135 X |
| 2,850,162 | 9/1958 | Widmer | 209/143 X |
| 3,005,547 | 10/1961 | Freeman | 209/32 |
| 3,269,532 | 8/1966 | Moore | 209/147 X |
| 3,742,650 | 7/1973 | Graf et al. | 51/425 X |
| 3,742,651 | 7/1973 | Rowe | 209/134 X |
| 3,900,969 | 8/1975 | Diehn | 51/425 |
| 3,934,372 | 1/1976 | Diehn et al. | 51/425 |
| 3,977,128 | 8/1976 | Goff | 51/425 |
| 4,020,596 | 5/1977 | Bergh | 51/425 |
| 4,052,820 | 10/1977 | Bergh | 51/423 |
| 4,202,142 | 5/1980 | Van Fossen | 51/425 |
| 4,275,531 | 6/1981 | Van Fossen | 51/425 |

FOREIGN PATENT DOCUMENTS

| | | | |
|---|---|---|---|
| 482361 | 6/1953 | Italy | 209/133 |
| 485557 | 10/1953 | Italy . | |
| 79/2058 | 4/1979 | South Africa . | |
| 1518785 | 7/1978 | United Kingdom . | |
| 1542495 | 3/1979 | United Kingdom . | |
| 1575477 | 9/1980 | United Kingdom . | |

OTHER PUBLICATIONS

Blast Cleaning & Shot Peening, Cleveland Metal Abrasives, Inc., 887 E 67th St., Cleveland, Ohio 44103, pp. 8–11.

*Primary Examiner*—Ralph J. Hill

*Attorney, Agent, or Firm*—Beveridge, DeGrandi & Kline

[57] ABSTRACT

An apparatus for separating debris from spent abrasive in an abrasive blasting apparatus in which the debris and spent abrasive are recirculated from a blast zone at high velocity along a recirculation chamber includes means for receiving debris and spent abrasive from the recirculation chamber and allowing a quantity of the debris and spent abrasive to collect thereby forming a pile having a face exposed to incoming debris and spent abrasive. The pile has an angle of repose, whereby additional incoming debris and sent abrasive fall down the face to form a substantially unobstructed, vertical, uniform curtain of falling debris and spent abrasive. Means for providing a stream of fluid through the recirculation chamber are provided. Means having first and second openings are provided for drawing off the stream of fluid, which is divided into portions, from the recirculation chamber. The falling curtain of debris and spent abrasive is washed by the stream of fluid as it passes from the recirculation chamber to the drawing means to entrain the debris from the falling curtain in the stream of fluid.

31 Claims, 2 Drawing Figures

APPARATUS FOR SEPARATING ABRASIVE BLASTING MEDIA FROM DEBRIS

CROSS-REFERENCE TO RELATED APPLICATION

This application is a continuation-in-part of application Ser. No. 232,465, filed Feb. 9, 1981, now U.S. Pat. No. 4,364,823, issued Dec. 21, 1982 the entire contents of which are relied upon and incorporated herein by reference.

BACKGROUND OF THE INVENTION

The present invention relates to apparatus for separating spent abrasive blasting media from debris loosened by an abrasive blasting operation.

Abrasive blasting apparatus and methods have taken various forms. Generally, an abrasive medium, such as sand or steel shot, is propelled at high velocity at the surface to be treated. The combined features of the abrasiveness of the medium and the high velocity at which it is propelled cause the surface to abrade and generate debris, such as dirt, paint and rust from the treated surface, and excessively fine abrasive media particles. The abrasive medium is reusable if the debris can be separated therefrom.

Various means have been employed in the art to allow the spent abrasive and debris to be reclaimed and to some extent to separate them from one another. For instance, British Pat. No. 1,542,495 discloses a device in which spent abrasive and debris are carried up a reclaim channel by the kinetic energy of the abrasive medium. In this apparatus the reclaim channel opens into a hopper, which acts also as a plenum, substantially decreasing the velocity of the air stream accompanying the abrasive medium and debris. The reduced velocity air stream no longer sustains the abrasive medium, but it does carry off the debris.

It is well known to separate debris from recycled abrasive media by the use of air washing methods. In these methods, the relative densities of the medium and contaminants are used to advantage, since the medium generally is more dense than the contaminants. The contaminated medium is caused to fall along a line in substantially continuous fashion so that a uniform "falling curtain" is obtained. An air stream is supplied through the falling curtain to entrain the contaminants and carry them away so that substantially uncontaminated abrasive medium can accumulate at the bottom of the curtain.

The uniformity of a falling curtain is important because voids or openings in the curtain allow the air to pass uninhibited and at increased velocity. The resulting increased velocity at the fringes of such a void or opening removes usable large abrasive particles. The reduced air stream velocity and volume in the remainder of the curtain results in incomplete washing.

There is a need in the art for an apparatus for separating debris from spent abrasive in an abrasive blasting apparatus in which the separation is very completely effected by the formation of a uniform falling curtain, and in which auxiliary air flows for air washing can be avoided.

SUMMARY OF THE INVENTION

The present invention fulfills this need by providing an apparatus for separating debris from spent abrasive in an abrasive blasting apparatus in which the debris and spent abrasive are recirculated from a blast zone at high speed along a recirculation chamber including means for receiving debris and spent abrasive from the recirculating chamber and allowing a quantity of the debris and spent abrasive to collect, thereby forming a pile of debris and spent abrasive having a face of the pile exposed to incoming debris and spent abrasive from the recirculation chamber. The pile has an angle of repose, whereby additional incoming debris and spent abrasive fall down the face to form a substantially unobstructed, vertical, uniform curtain of falling debris and spent abrasive. Means for providing a stream of fluid through the recirculation chamber and means disposed below the receiving means for drawing off the stream of fluid from the recirculation chamber are also provided. The falling curtain of debris and spent abrasive are washed by the stream of fluid as it passes from the recirculation chamber to the drawing means to entrain the debris from the falling curtain in the stream of fluid.

This invention also provides an apparatus for separating debris from spent abrasive in an abrasive blasting apparatus in which the debris and spent abrasive are recirculated from a blast zone at high speed along a recirculation chamber. The apparatus comprises means for receiving the debris and spent abrasive from the recirculation chamber. A quantity of the debris and spent abrasive is allowed to collect thereby forming a pile of debris and spent abrasive with a face of the pile exposed to incoming debris and spent abrasive from the recirculation chamber. The pile has an angle of repose whereby additional incoming debris and spent abrasive fall down the face to form a substantially unobstructed, vertical, uniform curtain of falling debris and spent abrasive. The apparatus includes means for providing a stream of fluid through the recirculation chamber. Means having a first opening are disposed below the receiving means for drawing off a first portion of the stream of fluid from the recirculation chamber. The drawing means has a second opening for the passage therethrough of a second portion of the stream of fluid not passing through the first opening. The falling curtain of debris and spent abrasive is washed by the stream of fluid as it passes from the recirculation chamber to the drawing means to entrain debris from the falling curtain in the stream of fluid.

Further, this invention provides an apparatus for separating debris from spent abrasive in an abrasive blasting apparatus in which abrasive is propelled at abrading velocity by a projecting means, such as a centrifugal blast wheel, unto a blast zone on the surface to be treated. Debris and spent abrasive are recovered from the blast zone and moved at high speed through a recirculation chamber to a hopper that feeds abrasive to the projecting means. The apparatus of the invention comprises means for receiving debris and spent abrasive from the recirculation chamber. A quantity of the debris and spent abrasive is allowed to collect thereby forming a pile of debris and spent abrasive with a face of the pile exposed to incoming debris and spent abrasive from the recirculation chamber. The pile has an angle of repose whereby additional incoming debris and spent abrasive strike the pile thereby dissipating kinetic energy of the incoming debris and abrasive, whereafter the debris and abrasive can fall down the face of the pile to form a substantially unobstructed, vertical, uniform curtain of falling debris and spent abrasive. The apparatus of the invention includes means for providing a stream of fluid through the recirculation chamber. Means having a first opening disposed below the receiving means for drawing off a first portion of the stream of fluid from the recirculation chamber are also provided. The drawing means has a second opening for the passage therethrough of a second portion of the stream of fluid not passing through the first opening. The second portion of fluid passes over the hopper and over the abrasive contained in the hopper before passage through the second opening. The falling curtain of debris and spent abrasive is washed by each portion of the stream of fluid as the portions flow to the drawing means to thereby entrain debris from the falling curtain in the stream of fluid.

In a preferred embodiment of the invention, the second portion of the stream of fluid entrains debris from the falling curtain that is not entrained in the first portion of the stream.

In another preferred embodiment of the invention, the receiving means can take the form of a cavity having an opening facing the recirculation chamber and a floor on which the pile of debris and spent abrasive forms. Preferably, the floor of the cavity has a lip adjacent to the opening shaped to facilitate the passage of air from the recirculation chamber to the drawing means.

In another preferred embodiment of this invention, the drawing means can take the form of a duct means with an entrance facing the recirculation chamber. The drawings means can include a valve for controlling the rate of flow of the stream of fluid. Preferably, the drawing means has a lower side, which is variable in length. Mobile blasting apparatus can very advantageously be designed to use the principles of the invention.

BRIEF DESCRIPTION OF THE DRAWINGS

This invention will be more fully understood by reference to the drawings, in which.

DETAILED DESCRIPTION OF PREFERRED EMBODIMENTS OF THE INVENTION

Figure 1:
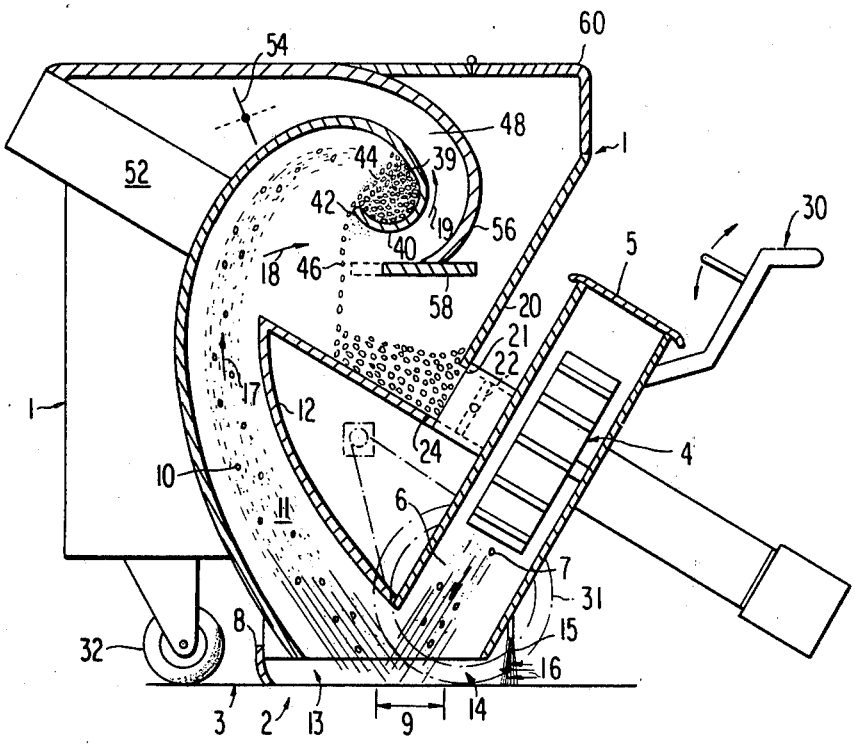
FIG. 1 is a cross-sectional view of a surface treating machine of this invention.

Referring to FIG. 1, there is depicted an abrasive throwing machine which, for example, is one adapted for treating a substantially flat, horizontal surface, such as a roadway, deck of a ship or storage tank. The machine comprises an enclosure generally designated as 1. The enclosure has an opening 2 therein adapted to confront a surface 3 to be treated with abrasive material. A centrifugal, airless, blast wheel 4 is provided within chamber 5 for projecting a stream 6 of abrasive particles 7 at an inclined angle relative to the surface 3 to be treated. A resilient sealing means 8 is provided around the periphery of the opening 2. The resilient sealing means 8 contacts the surface 3 and substantially prevents the escape of spent abrasive from enclosure 1. Abrasive particles 7 strike surface 3 within a blast zone 9. Spent abrasive particles 10 rebound upwardly along a rebound path generally designated as 11. This rebound path is also inclined at an angle relative to the surface 3.

The rebounding particles 10 enter an elongated, substantially unobstructed chamber 12. A storage hopper 20 is interposed between chamber 12 and blast wheel 4. Chamber 12 connects the blast zone 9 with the blast wheel 4 via hopper 20 making it possible to return to the blast wheel 4 spent abrasive rebounding from the blast zone. In the embodiment of the invention depicted in FIG. 1, elongated chamber 12 extends curvilinearly upward, gradually diminishes in cross-section from the blast zone 9 toward the hopper 20 and extends continuously to a level above the hopper.

The top of hopper 20 can be provided with an openable hatch cover 60 to facilitate access to the interior of the device for the addition of abrasive, servicing and the like.

The enclosure employed in the apparatus of this invention is generally made of light-weight material, such as thin gauge steel or aluminum. Portions of the enclosure can be lined with replaceable, abrasion-resistant material. For example, with reference to FIG. 1, the housing 5 in which the blast wheel 4 is installed can be lined with manganese steel, cast alloys or hardened plate. This is conveniently accomplished by using replaceable liners of the type well known in the art. Similarly, other surfaces of the enclosure subject to wear can be lined with abrasion-resistant material.

The opening 2 in the enclosure 1 has a front area generally designated as 13 in FIG. 1 and a rear area generally designated as 14. The front area 13 and the rear area 14 are outside the blast zone 9, but within the area bounded by seal 8. During operation of the device depicted in the Figure, there is a tendency for a small amount of spent abrasive to collect in the rear area 14. It is advantageous to recirculate this spent abrasive even though the quantity might be quite small. This can be accomplished by providing means for forcing spent abrasive in the rear area 14 back into the blast zone 9 in order that fresh abrasive 7 will strike the spent abrasive lying on surface 3 and blast it from the surface along the rebound path 11. This can conveniently be accomplished by applying suction through a dust collector 52 and providing for the entry of a fluid, such as a gas, preferably air, in the rear area 14. For instance, a portion of the resilient seal 8 adjacent rear area 14 may have at least one passage to permit the entry of the air from outside enclosure 1. Preferably, this portion of the resilient seal comprises a resilient brush means 15 adjacent to the rear area 14. Brush means 15 permits the flow of air along the path generally indicated as 16 in FIG. 1. This flow of air passes over the blast zone 9 and through the enclosure along the rebound path 11 and recycle path defined by 17, 18 and 19.

This flow of gas through the blast zone and along the recycle path makes a significant contribution toward returning spent abrasive to the blast wheel 4. The energy of the rebounding particles and the force on these particles by the flowing gas are together sufficient to carry the spent abrasive particles 10 along the recycle path 17, 18 and 19. This result can be enhanced by diminishing the cross-section of elongated chamber 12. As the gas travels through chamber 12, its velocity increases because of the diminishing cross-section of the chamber. Thus, as the rebounding spent abrasive particles gradually lose their kinetic energy while moving upwardly, this energy loss is at least partially compensated for by the gradually increasing velocity of gas. The diminishing cross-section of the chamber 12 also converts the uncontrolled stream of rebounding particles 10 into a controlled stream that can be guided and directed to cavity 39. It is to be understood that the diminishing cross-section of chamber 12 is a preferred, but not essential feature.

The wall of chamber 12 extends curvilinearly downward and terminates in a portion extending curvilinearly upward to thereby form a cavity 39. The stream of rebounding abrasive 11 and the debris that has been loosened from surface 3 are received in cavity 39 and collect in its receiving trough 40. Trough 40 has a lip 42 behind and above which the abrasive and debris build up to form a pile 44 as shown in FIG. 1. Eventually, the accumulation of abrasive and debris is such that additional debris and abrasive fall off of the pile or, in colliding with the pile 44, cause pile constituents to fall downwardly as at 46.

The kinetic energy of the abrasive reaching the pile is very great; it can have a speed on the order of about 200 to about 300 feet per second. The pile of abrasive and debris, rather than the equipment, absorbs the energy, greatly decreasing wear on the walls of cavity 39. The decrease is so great that it is sometimes possible to dispense with heavy wear plates in the region; this makes the machine lighter and easier to handle. The absorption of the kinetic energy of the incoming abrasive causes the pile 44 of abrasive and debris in trough 40 to be in a dynamic equilibrium so that the shape and size of the pile remain relatively constant despite the addition of incoming material and loss of falling material. Thus, the pile maintains a uniform angle of repose (of typically 45° to the vertical), and the dynamic equilibrium causes abrasive and debris to fall uniformly over lip 42 across its width. This effect is enhanced if the incoming abrasive and debris from reclaim chamber 12 are evenly distributed across the width of the chamber (i.e., into and out of the plane of FIG. 1).

The air stream in the recirculation chamber 12 is drawn off through a hood-shaped duct 48 to a suitable dust collector system 52.

Advantageously, duct 48 is provided with a valve, such as air gate 54, for controlling the volume of air drawn off. Gate 54 may be pivotably mounted in duct 48 to allow it to be oriented to substantially restrict the volume of air as shown in full lines in FIG. 1, or to present very little impedance to air flow as shown in phantom, or any orientation in between, depending on operating conditions. When the blasting apparatus is mobile, the gate 54 is generally left open as much as possible to aid in the recirculation of abrasive and debris from the treated surface.

Gate 54 is of particular utility when conditions downstream of the apparatus vary. For instance, if a dust collector 52 is employed, it may inhibit air flow. In this event, gate 54 is desirably opened. If a dust collector is not used, then closing gate 54 at least partially may diminish the volume of air to optimum levels.

Duct 48 is suitably formed with a lower side 56 having an adjustable extension 58 so that the length of lower side 56 is variable. Extension 58 may be slidably mounted (not shown) in enclosure 1 with adjustable controls (not shown) on the outside of enclosure 1 for determining its placement.

As the abrasive and debris fall uniformly across the width of lip 42, they are air washed by the stream of air along path 18, 19, such that the debris will be entrained in the air stream. Preferably, lip 42 is curved, as shown, to facilitate the passage of air stream along the portion 18 of the recycle path from the recirculating chamber 12 to the duct 48. Air streaming along the portion 19 of the recycle path with the entrained debris is directed to the dust collector 52 where the debris is removed and accumulated.

Variable extension 58 aids in preventing reusable abrasive from becoming entrained in air stream 19. This variability is particularly useful when the apparatus is to use different sizes of abrasive at different times. When smaller, lighter abrasive is used, the air stream moving along path 18, 19 will tend to deflect the falling curtain toward the lower side 56 of duct 48. Extension 58 can be retracted, as shown in solid lines in FIG. 1, to prevent the curtain from striking it and to prevent the reusable abrasive in the falling curtain from being entrained in the air stream.

Larger, heavier abrasive will form a curtain which is deflected less, so that extension 58 can be slid toward the curtain without causing entrainment, but increasing the effectiveness of the air wash. When larger particles of abrasive media are used, larger particles of debris can be removed from surface 3 and directed up the chamber 12. As the large abrasive medium and large debris particles fall from pile 44, the air stream moving along path 18, 19 deflects the larger debris particles from the falling curtain toward lower side 56. If extension 58 is positioned as shown in phantom in FIG. 1 (with its edge close to the falling curtain), the large debris will be more likely to be entrained in the air stream, since the effective suction in duct 48 is presented close to the debris particles. At least the large debris particles will fall on extension 58 from which they may be dislodged by later arriving large debris particles and thus entrained.

After having been air-washed, the abrasive particles fall into hopper 20 and are fed to the blast wheel 4 through an inlet port 21 having means 22 therein for controlling the rate of flow of the particles.

Figure 2:
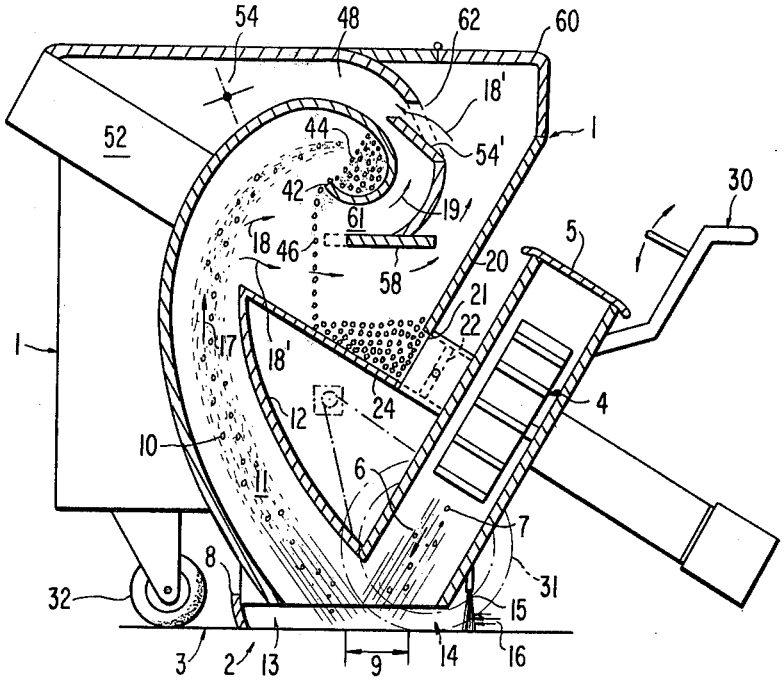
FIG. 2 is a preferred embodiment of the device shown in FIG. 1 in which the stream of fluid is withdrawn via multiple openings.

As previously described, the drawing means can include means for controlling the rate of flow of the stream of fluid through the apparatus. One embodiment of the means for controlling the stream of fluid is the valve 54 depicted in FIG. 1. Another embodiment of the invention is shown in FIG. 2 in which the duct 48 is provided with an opening 62 in one of its walls. The opening 62 can be a valve or adjustable gate means 54', such as a pivoted or slidable gate or valve. The gate means 54' can be adjusted by means (not shown) extending to the outside of the abrasive blasting machine.

As shown in FIG. 2, duct 48 has a variable extension 58 that forms a first opening 61 with the lip 42 of trough 40. Gate means 54' provides second opening 62.

In operation, a first portion of the stream of fluid, such as air, from the recirculation chamber 12 flows along path 18 through opening 61 into duct 48. A second portion of the steam of air from the recirculation chamber 12 moves along path 18', through the storage hopper 20 and over the abrasive contained therein up to the second opening 62 and then into duct 48. The first and second portions of the air stream pass through the falling curtain of abrasive 46 thereby entraining debris from the falling curtain and carrying the debris away from the abrasive. As depicted in FIG. 2, the second portion of the air stream passing along the path 18' into opening 62 entrains debris from the falling curtain that is not entrained in the first portion of the stream passing along the path 18 and into the opening 61.

As also depicted in FIG. 2, the first opening 61 faces the recirculation chamber 12. Second opening 62 is provided in duct 48 downstream of the first opening 61. By means of this arrangement, it is possible to employ gate means 54' for regulating the relative quantities of the first and second portions of the stream of fluid passing through first opening 61 and second opening 62. For example, when the top portion of gate means 54' is rotated to the right in the Figure, gate means 54' will eventually close, and in the process of closing the gate, more and more air from the recirculation chamber 12 will pass through the first opening 61; thus, the quantity of the first portion of air increases relative to the quantity of the second portion.

In the embodiment shown in FIG. 2, it is possible to also utilize gate 54 to regulate the flow of fluid through the duct 48. Use of gate means 54 is generally not required in the device depicted in FIG. 2. For this reason, gate means 54 is generally left in its full open position (as shown in FIG. 2) when gate means 54' is employed.

As previously mentioned, flow of fluid, such as air, through the machine is required in order to air-wash spent abrasive before the abrasive is reused. In addition, the apparatus depicted generates considerable heat during operation, and air flow through the apparatus aids in cooling. Furthermore, air flowing through the recirculation chamber can assist in recovery of spent abrasive from the surface being treated. For these reasons, it is frequently desirable to employ relatively large volumes of air. The large volume of air may travel at high velocity. It can be appreciated that a large volume of high velocity air entering duct 48 only through oopening 61 will have a tendency to disrupt the curtain of falling debris and spent abrasive and will be likely to carry abrasive with it into duct 48 and out of the machine. This results in waste of valuable abrasive. By providing another opening, such as opening 62 downstream of opening 61, a portion of the stream of air from the recirculation chamber 12 can bypass opening 61, yet still air-wash the falling curtain 46 of debris. In addition, as the second portion of air passes over the storage hopper, the velocity of the air is reduced because of the enlarged area of the hopper. Because of this reduction in velocity, there is less tendency for abrasive to be entrained in the air stream and removed from the machine.

The variable extension 58 can still be employed in the embodiment shown in FIG. 2 to regulate the size of opening 61 and the amount of air entering opening 61. In addition, second opening 62 can be employed to indirectly regulate the amount of air entering opening 61. The combined adjustments of variable extension 58 and gate means 54' make it possible to "fine tune" air flow conditions to achieve optimum separation of debris from the abrasive blasting medium.

In addition, in the embodiment depicted in FIG. 2, spent abrasive is shown as a curtain 46 falling from lip 42 to storage hopper 20. Because the stream of air from the recirculaton chamber 12 is divided into portions, and because these portions pass through different areas of the falling curtain of debris and spent abrasive, there is more thorough washing of the debris from the abrasive before the abrasive is reused. In addition, the second portion of air moving along path 18' scrubs residual dust and fines from the storage hopper 20 and the surface of the abrasive contained in the hopper.

Thus, not only does dividing the air from recirculation chamber 12 into portions reduce the velocity of the air and make it possible for each opening in the duct means to handle a smaller volume of air resulting in less disruption of the falling curtain of abrasive and less entrainment of abrasive in the air leaving the machine, but more efficient air washing of the falling curtain is achieved. In addition, larger quantities of debris can be removed from the machine.

This invention is particularly well suited to the type of machine described, that is, one in which the abrasive medium and debris are recirculated by the rebound energy of the abrasive medium supplemented with an air flow. In this invention the air flow that supplements the rebound energy of spent abrasive also acts to air wash the abrasive medium. If an auxiliary air flow were employed for air washing, it would tend to short circuit the air flow in the recirculation chamber, and the recirculation of the abrasive medium and debris would be impaired.

This invention can also be used to advantage in a surface treating apparatus of the type described in U.S. Pat. No. 3,977,128 to James R. Goff, and similar machines in which the return of spent abrasive and debris is aided by a mechanical assist, such as rotating brushes.

Although the above-discussed preferred embodiment employs the invention in an apparatus for cleaning the top of a substantially flat, horizontal surface, it will be understood that the invention can also be used in apparatus for abrasive blasting the bottom of horizontal surfaces or the sides of vertical surfaces.

Any of the well-known means for projecting abrasive particles against a surface to be treated and any type of conventional abrasive material can be employed in the device of this invention. For example, one can use metal shot, slag, sand, volcanic ash, glass beads, metal oxide particles, zircon, garnet, carborundum, stone and the like. When a blast wheel is employed, the rotational speed of the blast wheel and the quantity of abrasive required can be readily determined with a minimum of experimentation.

The air 16 can be provided by means of a vacuum or a forced air system. For example, the enclosure can be connected to means for providing a vacuum within the enclosure, such as by connection to a dust collector system. Air can then enter the brush means 15 in the lower portion of the enclosure. When a vacuum system is employed, it is preferable to connect the storage hopper 20 to the blast wheel 4 by means of a substantially air-tight seal in order to prevent short-circuiting of the air flow. The air flow 16 can also be provided by means capable of supplying air at a positive pressure near the brush 15.

It has been found that the air flow 16 should be of substantially high volume and low pressure or vacuum. In the preferred device previously described, an air flow of about 3–10 inches water column and ambient temperature has been found to be adequate.

The apparatus can also be provided with a steering handle, such as 30 in FIG. 1. The apparatus can be self-propelled by providing one or more drive wheels 31 near the rear of the machine. A caster wheel assembly 32 can be provided in the front of the machine. Controls for regulating the speed and direction of the machine and the speed of the throwing device can be mounted on steering handle 30. It will be apparent that the rate of travel of the machine can be adapted to suit a particular application. Preferably, variable speed controls are provided.

It will be understood that the device of this invention can be employed in mobilized abrasive throwing machines or incorporated in a stationary blasting apparatus. While the device has been described in connection with a mobile abrasive throwing machine and especially adapated for use in cleaning substantially flat, horizontal or inclined surfaces, the invention can be incorporated in any suitable blasting apparatus.

The device of this invention possesses several advantages. The device is compact, so that if used in a mobile machine, the resulting machine is quite maneuverable. The built-up pile 44 of spent abrasive and debris in trough 40 absorbs the kinetic energy of incoming abrasive so that wear-resistant plates are not needed on trough 40. This results in decreased cost and the elimination of downtime for periodic plate replacement. It also results in reduced weight of the machine, making it more suitable for cleaning the tops of relatively weak structures, such as storage tanks.

The built-up pile is kept in a dynamic equilibrium by the incoming debris and spent abrasive so that the falling curtain is substantially uniform in density over its width. The resulting curtain permits very effective air washing of the spent abrasive. The invention has the additional advantage that the portion of the device subjected to the impact of high velocity abrasive is free of moving parts which would otherwise be subject to wear. Furthermore, the air washing of the spent abrasive can be accomplished by using the air flow in the recirculation chamber, eliminating the need to provide any auxiliary air flow. The invention includes adjustment means so that the air washing conditions can be adapted to achieve efficient abrasive recovery even though the amount of debris or the size of abrasive may vary.

What is claimed is:

1. An apparatus for separating debris from spent abrasive in an abrasive blasting apparatus in which the debris and spent abrasive are recirculated from a blast zone at high speed along a recirculation chamber comprising means for receiving said debris and spent abrasive from said recirculation chamber and allowing a quantity of said debris and spent abrasive to collect thereby forming a pile of said debris and spent abrasive with a face of said pile exposed to incoming debris and spent abrasive from said recirculation chamber; wherein said pile has an angle of repose whereby additional incoming debris and spent abrasive fall down said face to form a substantially unobstructed, vertical, uniform curtain of falling debris and spent abrasive;

means for providing a stream of fluid through said recirculation chamber;

means having a first opening below said receiving means for drawing off a first portion of said stream of fluid from said recirculation chamber;

wherein said drawing means has a second opening for the passage therethrough of a second portion of said stream of fluid not passing through said first opening; and whereby said falling curtain of debris and spent abrasive is washed by said stream of fluid as it passes from said recirculation chamber to said drawing means to entrain debris from said falling curtain in said stream of fluid.

2. An apparatus as claimed in claim 1 wherein said second portion of said stream of fluid entrains debris from said falling curtain that is not entrained in said first portion of said stream.

3. An apparatus as claimed in claim 1 wherein said abrasive blasting apparatus is mobile.

4. An apparatus as claimed in claim 3 wherein said receiving means comprises a cavity having an opening facing said recirculation chamber and a floor on which said pile of debris and spent abrasive forms.

5. An apparatus as claimed in claim 4 wherein said floor of said cavity has a lip adjacent said opening, said lip being shaped to facilitate passage of said fluid from said recirculation chamber to said drawing means.

6. An apparatus as claimed in claim 1 wherein said drawing means comprises a duct means with an entrance facing said recirculation chamber.

7. An apparatus as claimed in claim 6 wherein said drawing means further comprises a valve means in said duct means for controlling the rate of flow of said stream of fluid.

8. An apparatus as claimed in claim 6 wherein said first opening in said drawing means corresponds to said entrance facing said recirculation chamber and said second opening is provided in said duct means downstream of said first opening.

9. An apparatus as claimed in claim 8 wherein said second opening is provided with an adjustable gate means for regulating the relative quantities of said first and second portions of said stream of fluid.

10. An apparatus as claimed in any one of claims 1 to 9 wherein said drawing means has a lower side which is variable in length.

11. An apparatus for separating debris from spent abrasive in an abrasive blasting apparatus in which abrasive is propelled at abrading velocity by a projecting means onto a blast zone on a surface to be treated and debris and spent abrasive are recovered from the blast zone and moved at high speed through a recirculation chamber to a hopper for feeding abrasive to the projecting means, said apparatus comprising means for receiving said debris and spent abrasive from said recirculation chamber and allowing a quantity of said debris and spent abrasive to collect thereby forming a pile of said debris and spent abrasive with a face of said pile exposed to incoming debris and spent abrasive from said recirculation chamber; wherein said pile has an angle of repose whereby additional incoming debris and spent abrasive strike said pile thereby dissipating kinetic energy of said incoming debris and abrasive, whereafter said debris and abrasive can fall down said face to form a substantially unobstructed, vertical, uniform curtain of falling debris and spent abrasive;

means for providing a stream of fluid through said recirculation chamber;

means having a first opening below said receiving means for drawing off a first portion of said stream of fluid from said recirculation chamber, wherein said drawing means has a second opening for the passage therethrough of a second portion of said stream of fluid not passing through said first opening, said second portion passing over said hopper and over the abrasive contained therein before passage through said second opening;

whereby said falling curtain of debris and spent abrasive is washed by each portion of said stream of fluid as the portions flow to the drawing means thereby entraining debris from said falling curtain in said stream of fluid.

12. An apparatus as claimed in claim 11 wherein said second portion of said stream of fluid entrains debris from said falling curtain that is not entrained in said first portion of said stream.

13. An apparatus as claimed in claim 12 wherein said receiving means comprises a cavity having an opening facing said recirculation chamber and a floor on which said pile of debris and spent abrasive forms.

14. An apparatus as claimed in claim 11 wherein said abrasive blasting apparatus is mobile.

15. An apparatus as claimed in claim 14 wherein said floor of said cavity has a lip adjacent said opening, said lip being shaped to facilitate passage of said fluid from said recirculation chamber to said drawing means.

16. An apparatus as claimed in claim 11 wherein said drawing means comprises a duct means with an entrance facing said recirculation chamber.

17. An apparatus as claimed in claim 16 wherein said drawing means further comprises a valve means in said duct means for controlling the rate of flow of said stream of fluid.

18. An apparatus as claimed in claim 16 wherein said first opening in said drawing means corresponds to said entrance facing said recirculation chamber and said second opening is provided in said duct means downstream of said first opening.

19. An apparatus as claimed in claim 18 wherein said second opening is provided with an adjustable gate means for regulating the relative quantities of said first and second portions of said stream of fluid.

20. An apparatus as claimed in any one of claims 11 to 19 wherein said drawing means has a lower side which is variable in length.

21. An abrasive throwing machine comprising an enclosure having an opening therein adapted to confront a surface to be treated with abrasive;

means within the enclosure for propelling abrasive at abrading velocity onto a blast zone on the surface;

recirculation chamber means connecting said surface with said projecting means for recirculating spent abrasive from the blast zone at high speed through the recirculation chamber and then to the abrasive propelling means for re-use;

means for receiving debris and spent abrasive from said recirculation chamber and allowing a quantity of said debris and spent abrasive to collect thereby forming a pile of said debris and spent abrasive with a face of said pile exposed to incoming debris and spent abrasive from said recirculation chamber; wherein said pile has an angle of repose whereby additional incoming debris and spent abrasive fall down said face to form a substantially unobstructed, vertical, uniform curtain of falling debris and spent abrasive;

means for providing a stream of fluid through said recirculation chamber;

means having a first opening below said receiving means for drawing off a first portion of said stream of fluid from said recirculation chamber;

wherein said drawing means has a second opening for the passage therethrough of a second portion of said stream of fluid not passing through said first opening; and whereby said falling curtain of debris and spent abrasive is washed by said stream of fluid as it passes from said recirculation chamber to said drawing means to entrain debris from said falling curtain in said stream of fluid.

22. An abrasive throwing machine as claimed in claim 21 wherein said receiving means comprises a cavity having an opening facing said recirculation chamber and a floor on which said pile of debris and spent abrasive forms;

said drawing means comprises a duct means with an entrance facing said recirculation chamber; and said first opening in said drawing means corresponds to said entrance facing said recirculation chamber and said second opening is provided in said duct means downstream of said first opening.

23. An abrasive throwing machine as claimed in claim 22 wherein said second opening is provided with an adjustable gate means for regulating the relative quantities of said first and second portions of said stream of fluid.

24. An abrasive throwing machine as claimed in claim 23 wherein said recirculation chamber means is an elongated, substantially unobstructed chamber, and said machine includes a storage hopper for feeding abrasive to said abrasive propelling means and said recirculation chamber means extends to a level above said hopper.

25. An abrasive throwing machine comprising an enclosure having an opening therein adapted to confront a surface to be treated with abrasive;

means within the enclosure for propelling abrasive at abrading velocity onto a blast zone on the surface;

recirculation chamber means connecting said surface with said projecting means for recirculating spent abrasive from the blast zone at high speed through the recirculation chamber and then to the abrasive propelling means for re-use;

means for receiving debris and spent abrasive from said recirculation chamber and allowing a quantity of said debris and spent abrasive to collect thereby forming a pile of said debris and spent abrasive with a face of said pile exposed to incoming debris and spent abrasive from said recirculation chamber; wherein said pile has an angle of repose whereby additional incoming debris and spent abrasive strike said pile thereby dissipating kinetic energy of said incoming debris and abrasive, whereafter said debris and abrasive can fall down said face to form a substantially unobstructed, vertical, uniform curtain of falling debris and spent abrasive;

means for providing a stream of fluid through said recirculation chamber;

means having a first opening below said receiving means for drawing off a first portion of said stream of fluid from said recirculation chamber;

storage hopper means for feeding abrasive to said abrasive propelling means;

wherein said drawing means has a second opening for the passage therethrough of a second portion of said stream of fluid not passing through said first opening, said second portion passing over said hopper and over the abrasive contained therein before passage through said second opening;

whereby said falling curtain of debris and spent abrasive is washed by each portion of said stream of fluid as the portions flow to the drawing means thereby entraining debris from said falling curtain in said stream of fluid.

26. An abrasive throwing machine as claimed in claim 25 wherein said receiving means comprises a cavity having an opening facing said recirculation chamber and a floor on which said pile of debris and spent abrasive forms;

said drawing means comprises a duct means with an entrance facing said recirculation chamber; and said first opening in said drawing means corresponds to said entrance facing said recirculation chamber and said second opening is provided in said duct means downstream of said first opening.

27. An abrasive throwing machine as claimed in claim 26 wherein said second opening is provided with an adjustable gate means for regulating the relative quantities of said first and second portions of said stream of fluid.

28. An abrasive throwing machine as claimed in claim 27 wherein said recirculation chamber means is an elongated, substantially unobstructed chamber, and said recirculation chamber means extends to a level above said hopper.

29. An abrasive throwing machine comprising an enclosure having an opening therein adapted to confront a surface to be treated with abrasive;

means within the enclosure for propelling abrasive at abrading velocity onto a blast zone on the surface;

recirculation chamber means connecting said surface with said projecting means for recirculating spent abrasive from the blast zone at high speed through the recirculation chamber and then to the abrasive propelling means for re-use;

means for providing said stream of fluid through said recirculating chamber;

means for receiving said debris and spent abrasive from said recirculation chamber and allowing a quantity of said debris and spent abrasive to collect thereby forming a pile of said debris and spent abrasive with a face of said pile exposed to substantially all of the incoming high speed debris and spent abrasive from said recirculation chamber; wherein said pile has an angle of repose whereby additional incoming debris and spent abrasive lose a substantial proportion of their kinetic energy upon impacting said face and fall down said face to form a substantially unobstructed, vertical, uniform curtain of falling debris and spent abrasive; and means having an opening disposed below said receiving means in direct communication with said recirculation chamber for drawing off said stream of fluid from said recirculation chamber, whereby said falling curtain is washed of debris by said stream of fluid by passing the stream of fluid from said recirculation chamber through said falling curtain and into said opening of said drawing means to thereby entrain said debris from said falling curtain in said stream of fluid.

30. An abrasive throwing machine as claimed in claim 29 wherein said receiving means comprises a cavity having an opening facing said recirculation chamber and a floor on which said pile of debris and spent abrasive forms; and said drawing means comprises a duct means with an entrance facing said recirculation chamber.

31. An abrasive throwing machine as claimed in claim 30 wherein said recirculation chamber means is an elongated, substantially unobstructed chamber and said machine includes a storage hopper for feeding abrasive to said abrasive propelling means and said recirculation chamber means extends to a level above said hopper.

* * * * *